United States Patent [19]

Berman et al.

[11] Patent Number: 5,015,924

[45] Date of Patent: May 14, 1991

[54] PUPILLARY EFFICIENT LIGHTING SYSTEM

[75] Inventors: Samuel M. Berman, San Francisco; Don L. Jewett, Mill Valley, both of Calif.

[73] Assignee: The United States of America as represented by the United States Department of Energy, Washington, D.C.

[21] Appl. No.: 337,971

[22] Filed: Apr. 14, 1989

[51] Int. Cl.[5] ..... H05B 37/02; H05B 41/16

[52] U.S. Cl. ..... 315/324; 315/151; 315/158; 315/294

[58] Field of Search ..... 315/324, 325, 291, 294, 315/151, 152, 153, 155, 158, DIG. 4; 362/228, 23

[56] References Cited

U.S. PATENT DOCUMENTS

| | | | |
|---|---|---|---|
| 3,821,576 | 6/1974 | Larson | 313/25 |
| 3,965,388 | 6/1976 | Brisk | 315/155 |
| 4,234,820 | 11/1980 | Widmayer | 315/152 |
| 4,277,728 | 7/1981 | Stevens | 315/307 |
| 4,399,492 | 8/1983 | Kolesar | 362/106 |

OTHER PUBLICATIONS

"Pupillary Size Differences Under Incandescent and High Pressure Solium Lamps", Journal of the Illuminating Engineering Society, Winter—87, by: S. M. Berman et al.

*Primary Examiner*—Eugene R. LaRoche
*Assistant Examiner*—Ali Neyzari
*Attorney, Agent, or Firm*—L. E. Carnahan; Roger S. Gaither; William R. Moser

[57] ABSTRACT

A lighting system having at least two independent lighting subsystems each with a different ratio of scotopic illumination to photopic illumination. The radiant energy in the visible region of the spectrum of the lighting subsystems can be adjusted relative to each other so that the total scotopic illumination of the combined system and the total photopic illumination of the combined system can be varied independently. The dilation or contraction of the pupil of an eye is controlled by the level of scotopic illumination and because the scotopic and photopic illumination can be separately controlled, the system allows the pupil size to be varied independently of the level of photopic illumination. Hence, the vision process can be improved for a given level of photopic illumination.

9 Claims, 2 Drawing Sheets

PUPILLARY EFFICIENT LIGHTING SYSTEM

BACKGROUND OF THE INVENTION

The present invention relates to lighting systems and more particularly to a lighting system wherein the diameter of an eye pupil can be adjusted to improve the vision process. The United States Government has rights in this invention pursuant to Contract No. DE-AC03-76SF00098 between the U.S. Department of Energy and the University of California.

The portion of the electromagnetic spectrum that is perceived as visible light by the human vision system ranges in wavelength from approximately 400 nanometers (nm) to 700 nm. Energy located primarily in the vicinity of 400 nm is perceived as blue light, and, as the wavelength is increased, the perception of color changes from blue to green to orange to red. Radiant energies of wavelengths shorter than 400 nm (ultraviolet) or longer than 700 nm (infrared) cause other biological responses but are not perceived as visible light.

When the visual system is presented with a range of colors provided by equal energy per unit of wavelength, the visual response is that the various colors will not appear to be of equal brightness. This is because the physiological visual efficacy for brightness perception varies with wavelength. The greatest visual efficacy is from green light at a wavelength of 555 nm, and the efficacy becomes less from both blue and red colors. This efficacy, known as the photopic efficacy of the eye, is the basis for photometry as it is used in industry, photography and other societal applications.

The photopic response of the visual system is a result of the absorption properties of the three different cone pigments. These cones, with their color sensitive pigments, lie within the retina and combine to produce color vision in human as well as other living species.

However, the variation of brightness sensitation with wavelength changes character under extremely dim light levels, such as a moon-less night. At these extremely low levels of light intensity, the cones do not receive enough energy to participate in the vision process, and instead, another photosensitive component of the retina, the rods, become the principal means by which vision takes place. The rod pigment (rhodopsin) is chemically different from the cone pigments and the spectral response is likewise different. The rod response, known as the scotopic efficacy response, has a peak at 507 nm where the perceived color at photopic light is a greenish blue. The scotopic efficacy decreases as the wavelength increases or decreases from the peak efficacy at 507 nm.

Thus, there are two spectral response functions involved in the overall vision process, depending on the levels of illumination. At very low light levels, the rods are activated and objects are perceived by peripheral vision. As the light level increases, the cones receive enough energy to be activated and normal color vision takes over. Although it has often been accepted as a truism that the rods are no longer involved in the vision process when the cones take over, it has been shown that even at very bright levels of illumination, a large fraction of the rhodopsin remains unbleached, such that the pupil size is primarily controlled by the rods with a spectral response following the curve of scotopic efficacy response.

Light meters used by photographic illumination engineers and lighting designers incorporate into their detection systems the photopic response in order to simulate the brightness or luminous efficacy of the eye. The level of illumination, as measured by such a meter, is an integration of the various wavelengths of the spectral output of the light source, each multiplied by the visual brightness efficacy at that wavelength. Thus, two light sources with different spectral outputs may have the same level of photopic illumination even though the total actual energy output of the sources, as measured by a spectral radiometer, are quite different.

The numerical level of photopic illumination of a light source, as determined by such integration, is usually given in footcandles (English system) or lux (metric system). If desired, the level of scotopic illumination from the light source can be determined by a similar integration process, but using the curve of scotopic efficacy response, with the numerical measure of the level being given in scotopic footcandles or scotopic lux.

The degree of dilation or contraction of the eye pupil is important for many visual tasks. For example, a dilated pupil is desirable under low levels of illumination, such as in night driving, where it is more important to have a maximum amount of light enter the eye than it is to provide visual acuity or depth of field. On the other hand, a contracted pupil will provide better acuity and depth of field so that the vision efficiency is increased. In addition, less spherical aberration results with smaller pupil size.

However, with conventional illumination, the pupil size will vary directly with the output of the light source. If it is desired to increase the acuity and depth of field, the intensity of the light source must be increased to cause the pupil to contract. However, in many instances, such increase in intensity is either not possible or is uncomfortable.

SUMMARY OF THE INVENTION

It is the primary object of the present invention to provide a lighting system wherein the size of the pupil can be controlled independently of the level of photopic illumination.

It is a further object to provide a lighting system wherein it is possible to vary the pupil size wile the level of photopic illumination is held constant.

Additional objects, advantages and novel features of the invention will be set forth in the description which follows, and in part will become apparent to those skilled in the art upon examination of the following, or may be learned by practice of the invention. The objects and advantages of the invention may be realized and attained by means of the instrumentalities and combinations pointed out in the appended claims.

To achieve the foregoing and other objects, and in accordance with the present invention, as described and broadly claimed herein, a lighting system is provided having at least two lighting subsystems with different spectral power distributions, and with means to vary the total scotopic illumination from the system while maintaining the total photopic illumination from the system at a desired level.

A further aspect of the invention lies in the use of a detection and control system to maintain the total photopic illumination from the lighting system at a constant level as the total scotopic illumination from lighting system is varied.

BRIEF DESCRIPTION OF THE DRAWINGS

The accompanying drawings, which are incorporated in and form part of the application, together with the description, serve to explain the principles of the invention.

DESCRIPTION OF PREFERRED EMBODIMENTS

Figure 1:
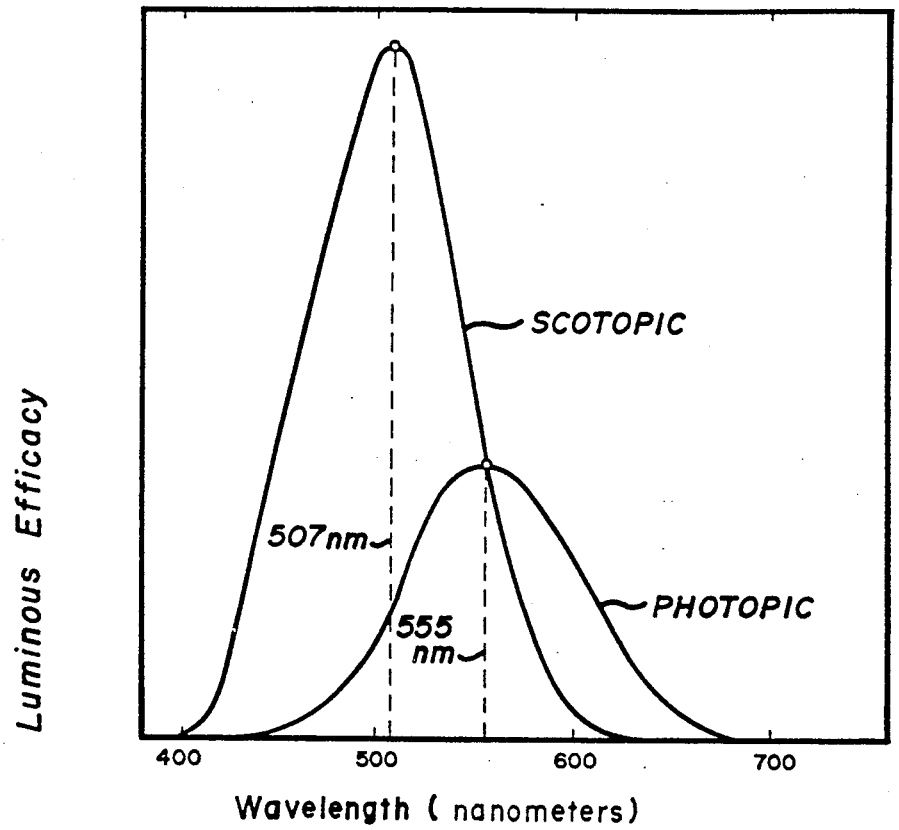
FIG. 1 shows graphs illustrating the luminous efficacy for photopic and scotopic vision.
Figure 2:
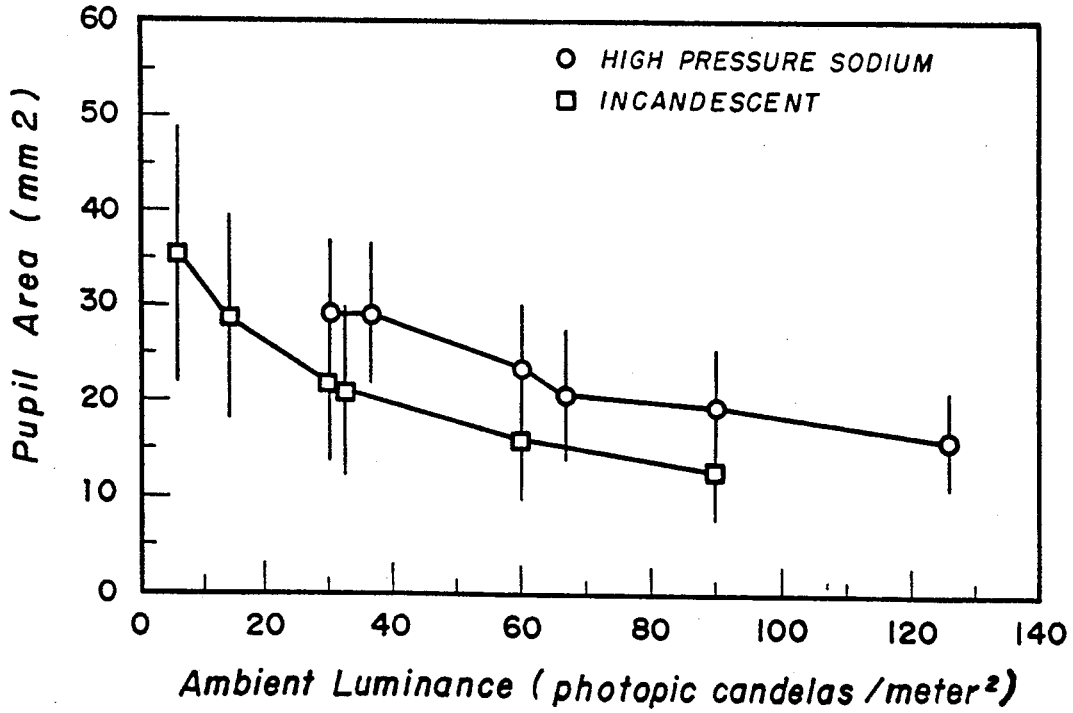
FIG. 2 shows graphs relating pupil size to photopic rich and scotopic rich illumination.

FIGS. 1 and 2 illustrate the principles involved in the present invention. As mentioned previously, the efficacy of the physiological response to photopic illumination is maximum at a wavelength of 555 nm, and is maximum to scotopic illumination at a wavelength of 507 nm. The well-known curves for efficacy of photopic and scotopic illumination are shown in FIG. 1. As is noted, the two curves have a considerable overlap. As a consequence, any light source that has a spectral power distribution at many visible wavelengths will be perceived both scotopically and photopically.

The total amount of photopic illumination of a light source is determined by multiplying the spectral energy power distribution of each visible wavelength of the source by the degree of photopic luminous efficacy at that wavelength (FIG. 1) and by adding together all such values.

Similarly, the total amount of scotopic illumination of the same light source can be determined, but using the scotopic efficacy curve of FIG. 1.

If two light sources of different spectral power distributions are compared, the illumination from one of the light sources will be "scotopically rich" (or conversely, "photopically poor") as compared to the illumination from the other source if the ratio of total scotopic illumination to total photopic illumination of the first light source is greater than the same ratio for the second. In such case, the ratio of total photopic emission to total scotopic emission of the second light source would be greater than the same ratio for the first light source, and the second light source would be "photopically rich," as compared to the first light source.

FIG. 2 shows the result of tests conducted by applicants to determine the relationship of pupil size to two lamps, one of which is scotopically rich and the other is photopically rich. In particular, a number of individuals were separately exposed to indirect light from a photopically rich high pressure sodium lamp alone and from a scotopically rich incandescent lamp alone, with the intensity of illumination being varied for each lamp, and with the same photometric meter being used to measure the ambient luminance. At the same time, the pupil area was measured using an infrared detection technique.

As shown in FIG. 2, for a given level of photopic illumination the pupil size will be more dilated when the lamp is photopically rich (or scotopically poor), and will be more contracted if the lamp is scotopically rich (or photopically poor).

It follows then, from the results of FIG. 2, that two light sources that provide equal photopic illumination will not provide the same pupil size response if they emit different energies in the scotopic region of the spectrum. Furthermore, by separately controlling the amount of illumination from the two light sources to: (1) those at which the pupil is most sensitive; and (2) those at which the cones are most sensitive, it is possible to obtain a wide variety of pupil sizes while the level of total photopic illumination is held constant.

Figure 3:
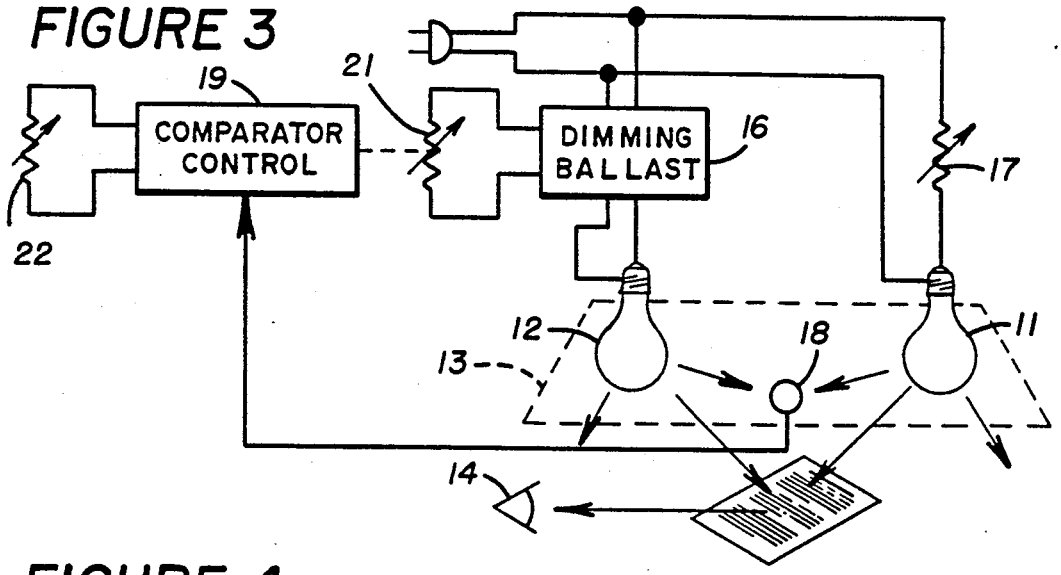
FIG. 3 is a generally schematic illustration of one embodiment of the invention using an incandescent lamp and a sodium lamp.

FIG. 3 illustrates an embodiment of a lighting system of the present invention, having a lighting subsystem which includes one or more scotopically rich incandescent lamps 11 and a lighting subsystem which includes one or more photopically rich high pressure sodium lamps 12. The lamps can be mounted in a single housing 13, or in separate housings, as long as the light emitted from the subsystems can be concurrently detected at a reception location, represented by the eye 14.

It is desirable that the lamps of the subsystems have approximately the same level of photopic emission if either subsystem is on by itself. For example, the incandescent lamp 11 may be a 150 watt lamp while the high pressure sodium lamp 12 is a 35 watt lamp. The dimming ballast 16 of the high pressure sodium lamp may be operated at either high frequency (above 25,000 Hertz) in order to eliminate any lamp flicker, or at a normal line voltage frequency of 60 Hertz, as desired.

The incandescent lamp 11 is provided with a dimming control represented by variable resistor 17, so that the total illumination from lamp 11 can be manually controlled.

A photopic light sensor 18, having a response curve substantially the same as the photopic luminous efficacy curve of FIG. 1, is positioned to receive emitted light from both lamps 11 and 12, and will produce a signal whose magnitude is a function of the total photopic illumination from both lamps 11 and 12. The signal from light sensor 18 is sent to comparator control 19 which functions in a conventional manner to compare the magnitude of the signal with a reference voltage. If the signal is greater than the reference voltage, the comparator control 19 will actuate the dimming member 21 of the dimming ballast to reduce the intensity of lamp 12 so that the total photopic illumination from both lamps 11 and 12 is reduced to a desired level. Likewise, if the magnitude of the signal from light sensor 18 is less than the reference voltage, the comparator control 19 will cause the output from lamp 12 to be increased so that the total photopic illumination from both lamps is increased back to the desired level of photopic illumination. A manually operable dimming member 22 is provided to vary the magnitude of the reference voltage in comparator control 19 so that the level of total photopic illumination of the two lamps 11 and 12 may be adjusted as desired.

When the system of FIG. 3 was used in the tests discussed above in connection with FIG. 2, it was found that if the high pressure sodium lamp 11 was suddenly turned off and the incandescent lamp (of equal photopic intensity) was immediately turned on, there was an immediate contraction of the pupil area by about 50%.

Figure 4:
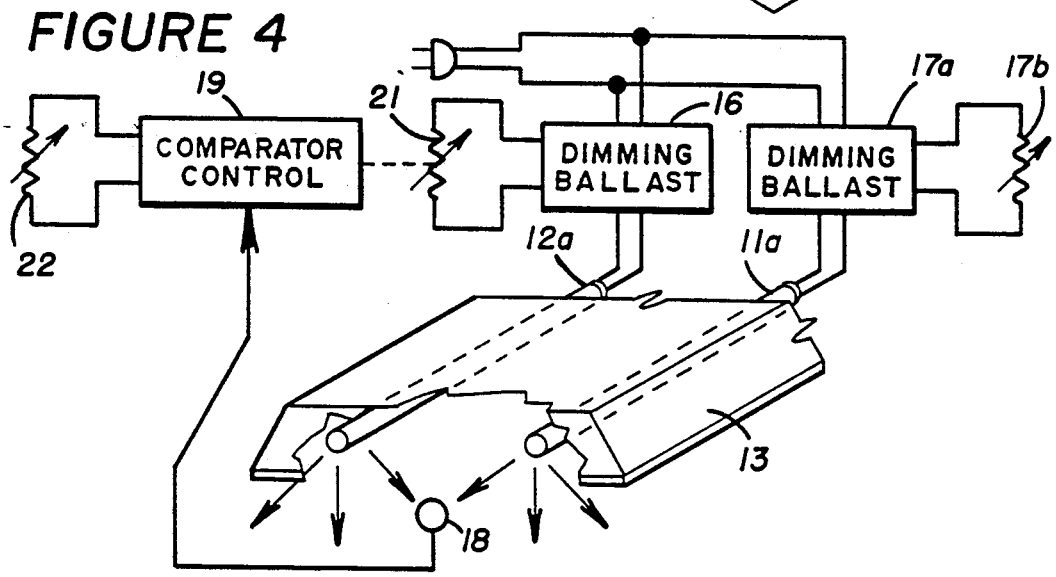
FIG. 4 is a generally schematic illustration of another embodiment of the invention using two fluorescent lamps having different phosphors which favor scotopic and photopic illumination, respectively.

FIG. 4 illustrates another embodiment of a lighting system in accordance with the present invention, having two lighting subsystems each having one or more fluorescent lamps 11*a* and 12*a*, respectively. A dimming ballast 17*a*, with a manual control member 17*b* is provided for manual control of the level of illumination from the lighting subsystem which includes lamp 11*a*, while dimming ballast 16 and control member 21 thereof are used for control of illumination from the lighting subsystem which includes lamp 12*a*.

In this embodiment, the fluorescent lamps 11*a* and 12*a* are coated with selected phosphors that favor scotopic and photopic illumination respectively. For example, Sylvania phosphor #213 provides light just at the peak region of the scotopic efficacy curve (FIG. 1), and can be used to coat lamp 11*a*. Lamp 12*a* can then be a typical "warm white" fluorescent lamp which will be photopically rich as compared to lamp 11*a*.

As before, the comparator control 19 is used to maintain the total photopic illumination from both subsystems at a constant desired level even though the level of total scotopic illumination from the subsystems is varied, as by manual control 17*b*.

Figure 5:
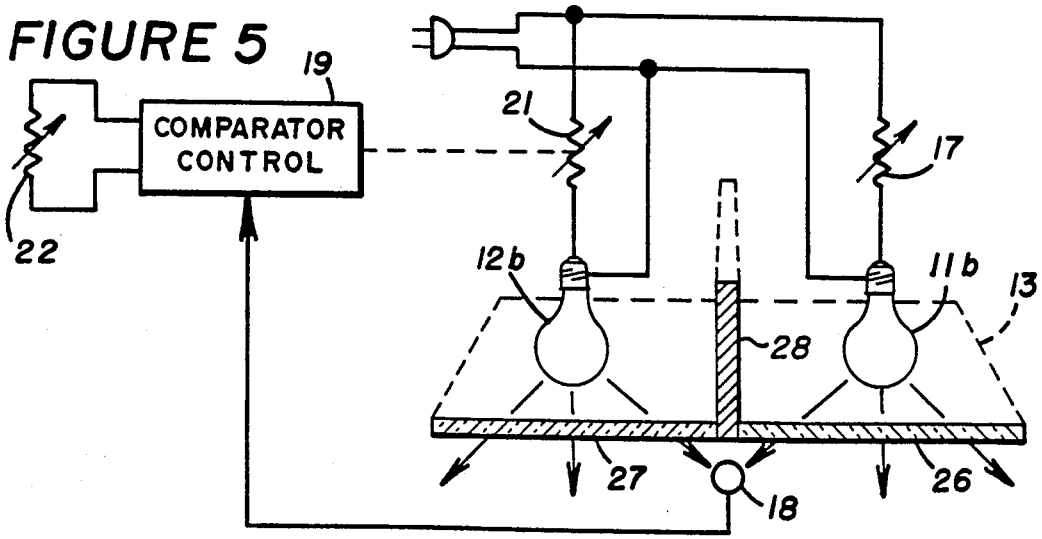
FIG. 5 is generally schematic illustration of yet another embodiment of the invention using two similar lamps with individual filters therefor, the filters favoring scotopic and photopic transmission, respectively.

FIG. 5 illustrates yet another embodiment of a lighting system in accordance with the present invention. In this embodiment, separate lamps 11*b* and 12*b* are used, which lamps may be identical, if desired. The illumination from the lamps are passed separately through filters 26 and 27, with filter 26 favoring scotopic transmission and filter 27 favoring photopic transmission so that the filtered illumination from lamps 11*b* and 12*b* are scotopically rich and photopically rich, respectively. An opaque divider 28 separates the lamps 11*b* and 12*b* so that the light from lamp 11*b* does not pass through filter 27 and the light from lamp 12*b* does not pass through the filter 26.

In this embodiment, the lamp 11*b* and filter 26 constitutes one lighting subsystem while the lamp 12*b* and filter 27 constitutes a second lighting subsystem.

As before, the illumination from lamp 11*b* can be manually varied, with the illumination from lamp 12*b* being varied automatically to maintain the level of total photopic illumination of the combined lighting system at a desired level.

In any of the embodiments of the invention the greater the difference between the ratios of scotopic illumination to photopic illumination from the lighting subsystems, the greater will be the effectiveness of varying the total scotopic illumination of the two lighting subsystems relative to the total photopic illumination of the total lighting system.

The foregoing description of preferred embodiments has been presented for purposes of illustration and description. It is not intended to be exhaustive or to limit the invention to the precise forms described, and obviously many other modifications and variations are possible in light of the above teaching. The embodiments were chosen in order to explain most clearly the principles of the invention and its practical applications thereby to enable others in the art to utilize most effectively the invention in various other embodiments and with various other modifications as may be suited to the particular use contemplated. For example, each of the lighting subsystems may include either a single light emitting element or a plurality of such elements. Further, other devices may be interposed between the light sources and the reception location, such as variable shutters or variable density filters to provide for control of the level of the light emitted from the light sources for the purpose of achieving a variable value of the ratio of total scotopic illumination to total photopic illumination. It is intended that the scope of the invention be defined by the claims appended hereto.

We claim:

1. A pupillary efficient lighting system comprising at least two lighting subsystems each emitting visible light with different spectral power distributions which can be concurrently detected at a reception location, means for varying the total scotopic illumination from said lighting system while maintaining the total photopic illumination from said lighting system at a desired level.

2. A pupillary efficient lighting system as set forth in claim 1, wherein said lighting subsystem includes at least one incandescent lamp and at least one sodium lamp.

3. A pupillary efficient lighting system as set forth in claim 1, wherein said lighting subsystems includes at least one fluorescent lamp coated with a phosphor favoring scotopic emission and at least one fluorescent lamp coated with a phosphor favoring photopic emission.

4. A pupillary efficient lighting system as set forth in claim 1, wherein one of said lighting subsystems includes a first lamp and a first filter through which the light from said first lamp passes, said first filter favoring the transmission therethrough of scotopically rich light, and wherein a second of said lighting subsystems includes a second lamp and a second filter through which the light from said second lamp passes, said second filter favoring the transmission therethrough of photopically rich light.

5. A pupillary efficient lighting system as set forth in claim 1, wherein the varying means includes means for varying the level of illumination from the lighting subsystem with a spectral power distribution which is scotopically rich, and further including control means for varying the level of illumination from the lighting subsystem with a spectral power distribution which is photopically rich to maintain the total photopic illumination from said lighting system at a constant level as the level of illumination from the scotopically rich lighting subsystem is varied.

6. A pupillary efficient lighting system as set forth in claim 5, wherein the scotopically rich lighting subsystem includes at least one incandescent lamp and the photopically rich lighting subsystem includes at least one sodium lamp.

7. A pupillary efficient lighting system as set forth in claim 5, wherein the scotopically rich lighting subsystem includes at least one fluorescent lamp coated with a phosphor favoring scotopic illumination and the photopically rich lighting subsystem includes at least one fluorescent lamp coated with a phosphor favoring photopic illumination.

8. A pupillary efficient lighting system as set forth in claim 5, wherein the scotopically rich lighting subsystem includes a first lamp and a first filter through which the light from said first lamp passes, said first filter favoring the transmission therethrough of scotopically rich light, and wherein the photopically rich lighting subsystem includes a second lamp and a second filter through which the light from said second lamp passes, said second filter favoring the transmission therethrough of photopically rich light.

9. A pupillary efficient lighting system as set forth in claim 5, wherein said control means includes a light sensor responsive to photopic illumination and positioned to receive total illumination from said lighting system, said light sensor being operable to produce a signal whose magnitude is a function of the total photopic illumination of the lighting system, and means for comparing said signal with a reference voltage.

* * * * *